United States Patent [19]

Bell

[11] Patent Number: 4,547,097

[45] Date of Patent: Oct. 15, 1985

[54] TRAVELING TRENCH SHORE

[76] Inventor: Noel G. Bell, 52 West Hudson Ave., Englewood, N.J. 07631

[21] Appl. No.: 504,501

[22] Filed: Jun. 15, 1983

[51] Int. Cl.[4] ..... E21D 5/12

[52] U.S. Cl. ..... 405/283; 405/272

[58] Field of Search ..... 405/272, 282, 283, 258, 405/303, 273

[56] References Cited

U.S. PATENT DOCUMENTS

| | | | |
|---|---|---|---|
| 3,541,799 | 11/1970 | Jost et al. | 405/283 |
| 3,641,773 | 2/1972 | Morrice | 405/283 |
| 3,715,889 | 2/1973 | Bixler et al. | 405/283 |
| 3,820,345 | 6/1974 | Brecht | 405/283 |
| 3,967,454 | 7/1976 | Barnes | 405/282 |

FOREIGN PATENT DOCUMENTS

| | | | |
|---|---|---|---|
| 2652327 | 5/1978 | Fed. Rep. of Germany | 405/145 |

*Primary Examiner*—Dennis L. Taylor

[57] ABSTRACT

A traveling trench shoring device consisting of longitudinal panels which cover the walls of the trench completely and are supported by movable frames, the panels being moved forward by jacks connecting the panels to the frames which are held in place by the friction between the walls and other panels, the device comprising a working chamber and a separate unconnected sloping approach section, and panels which can be raised individually and have cover plates on their lower outer edges and ends to prevent entry of earth between them and panels below and behind them, the connections for the jacks on the frames also being movable vertically and individually.

9 Claims, 4 Drawing Figures

TRAVELING TRENCH SHORE

This invention refers to means of shoring trench excavation.

Common existing means of shoring trenches in fairly stiff ground, that is ground which stands up nearly vertically or at a high angle, is a trench box made of steel, open at the top and bottom and with an opening for a pipe in the rear, and is mainly to protect workmen. It is dragged along the trench by an excavator, generally a backhoe. In soft ground, sand and soft clay, common means are steel sheet pile walls; panels placed as the trench is excavated deeper; and, for subway systems, vertical steel H piles with horizontal timber lagging; and diaphragm "slurry" walls.

The main object of the invention is to provide a cheaper and faster means of shoring trenches in soft ground, and particularly to prevent loss of ground into the trench when excavating in water bearing sand and soft clay and, in city streets, to avoid undermining and settlement of buildings. Therefore the shore covers the walls of the trench completely and has an approach section with a slope conforming to the angle of repose of the ground.

A further object is to make the shore more flexible for adjusting the grade and traversing horizontal and vertical curves. Therefore the panels are made shorter by making the shore in separate sections, and the panels and the mountings for jack connections are made movable vertically individually without the necessity and power required for raising the other panels and the frame at the same time. Also the panels can be raised without interupting the forward movement of the shore.

The invention provides a traveling trench shore consisting of longitudinal panels which cover the walls of the trench completely and are supported by movable frames, the panels being moved forward by jacks connecting the panels to the frames which are held in place by the friction between the walls and other panels, the shore comprising a working chamber and a separate unconnected sloping approach section, and panels which can be raised individually and have cover plates on their lower outer edges and ends to prevent entry of earth between them and panels below and behind them, the connections for the jacks on the frames also being movable vertically and individually.

The following drawings show some embodiments of the invention.

Figures 1, 2, 3, 4:
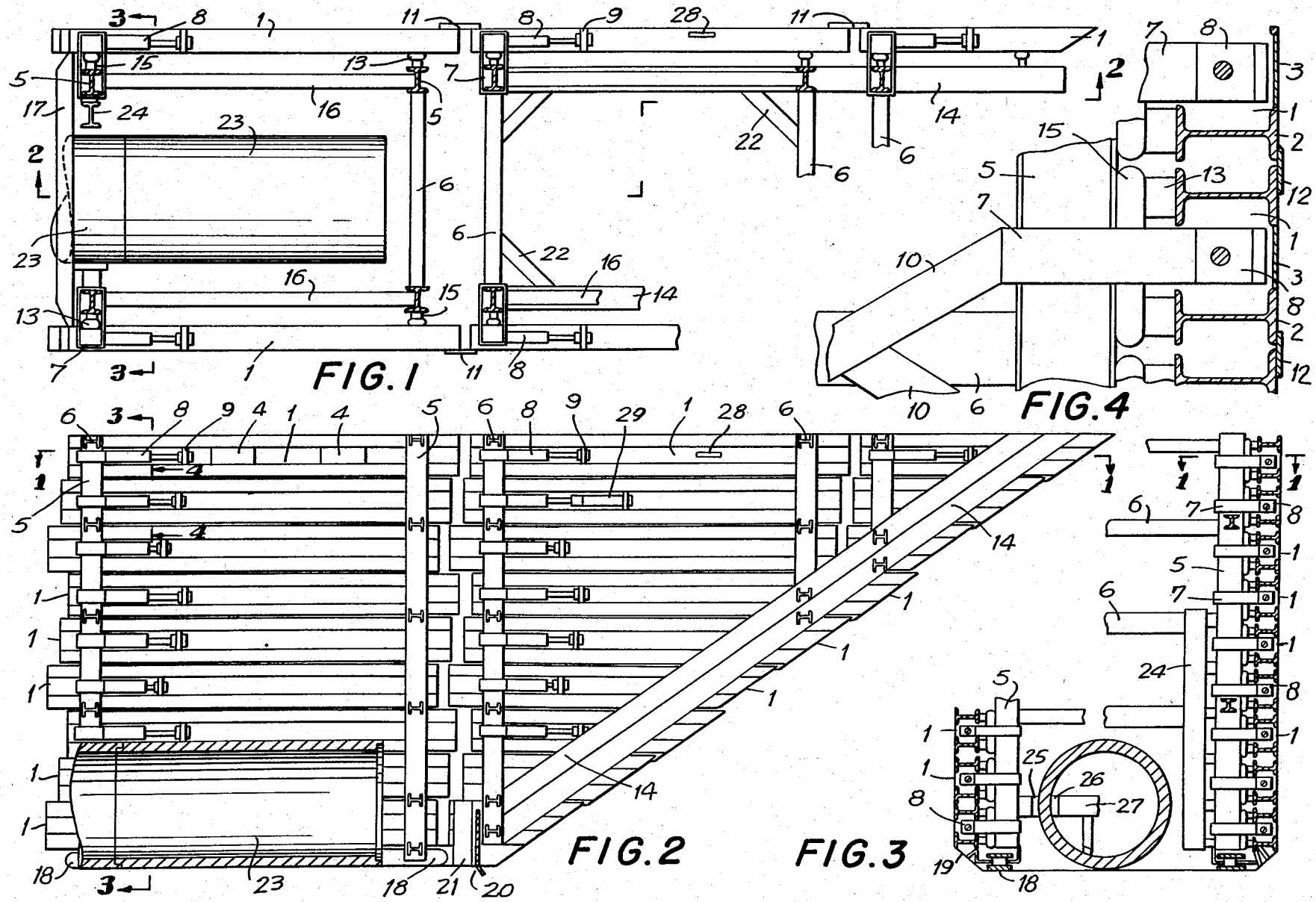
FIG. 1 is a part plan section.
FIG. 2 is a vertical long section.
FIG. 3 is a part cross section.
FIG. 4 is a cross section, to an enlarged scale, of part of FIG. 3.

The shore shown is nine panels deep.

A panel 1 consists of two beams 2 joined on the outside by a plate 3 and inside by short plates 4. The panels are supported against earth pressure by vertical soldier beams 5 which are braced by cross braces 6. Collars 7 around the beams 5 project into the panels and form mounts for hydraulic jacks 8 whose pistons are connected to the panels by brackets 9. The collars 7 have plates 10 which engage the cross braces 6 to reduce torque on the soldier beams. The panels have cover plates 11 on their ends, as shown in FIG. 1, and cover plates 12 on their lower edges, as shown in FIG. 4.

Travel of a panel is effected by pushing with a jack, the reaction being taken by the soldier beam that is held in position by the other jacks which are held by the friction of the other panels. After all the panels are moved forward, the soldier beams are pulled forward by the jacks. Preferably, every third jack (counting vertically) is operated simultaneously and thus has the friction on the two stationary panels for reaction. In this way the time for travel is only limited by the time taken to move three panels plus the soldier beams, independently of the number of panels and depth of the trench. As shown in FIG. 2 the top panel has been moved forward, the second is in process and the third has not yet moved. The short leading panels which form cutting edges may be pushed by the panels behind, instead of having individual jacks.

Two or three panels at the top where the pressure is light might be moved as a unit. Jacks may be connected to the front soldier beams and thus pull instead of push panels. The prime power unit may travel alongside the trench or on top of it and the travel of the panels is controlled from a console.

Dollies 13, consisting of an endless chain of rollers of the known type used for moving heavy loads, which roll longitudinally, are mounted on the collars 7 on the soldier beams to allow the panels to roll forward.

Vibrators 28 may be mounted on the sides of the panels or on the brackets 9 on the side opposite the jack piston, to reduce friction, between the panels and the walls. If individual vibrators are not necessary, a removable cross brace with a hydraulic jack and vibrator at one end, and a vibrator at the other, might be used.

Additionally or alternatively, percussion tools 29, as used for example on heavy paving breakers or other hammers, may be mounted between the brackets 9 and the ends of the jack pistons, to overcome the friction between the panels and the walls.

On horizontal curves, the jacks on the outside of the curve may be driven faster than those on the inside. Pressure may be applied to the diagonal waling 14 on the approach slope, and the side of the slope on the inside of the curve may be excavated slightly ahead of and deeper than on the outside. Also, a jet of air or water or both may be used on the earth outside the panel on the inside of the curve.

Vertical curves may be traversed by raising one end of each panel in turn, the front end for upward curves and the rear end for down curves. To facilitate this, vertically rolling dollies 15 may be mounted on the backs of the dollies 13 and roll on the soldier beams 5. The cover plates 12 prevent entry of earth.

The soldier beams 5 are joined into pairs by longitudinal ties 16 to form a frame. A bulkhead 17 at the end of the work chamber keeps out earth. The ties 16 and the bulkhead are omitted for clarity from FIG. 2. A roller may be mounted on top of the mounts for the jacks to support the panels. The soldier beams may be turned at right angles to afford a housing for the dollies and provide more room in the chamber. The vertically rolling dollies 15 may be omitted if not required.

In trenches where the pipe 23 or other permanent work interferes with the cross braces 6, the soldier beams 5 may be made stronger or, as shown in FIG. 3 right side, a cantilever beam 24 may be placed inside or alongside the soldier beam. Alternatively, as shown on the left side, a strut with a dolly 25 with concave rollers which rolls longitudinally may transfer the the load to the pipe, and a dolly 26 with convex rollers on a traveling frame 27 may transmit the load across the pipe and relieve the stress in it.

The panel walls may be set on a batter to reduce the pressure on the panels and on the bottom of the trench. A pair of crawler tracks 18 may be mounted at the bottom of the shore with a cover plate 19 attached.

An adjustable dozer blade 20 and a box 21 for bedding material are mounted as shown in FIG. 2. Knee braces 22 are provided. Cross braces may be of telescopic pipes with a screw jack at end. Jets of air or water or both may be provided at the leading edges of panels on slope to assist excavation. To allow more room for work chamber and excavation, the pair of adjacent cross braces 6 at the ends of the panels may be replaced by a single brace with short beams across the soldier beams.

The shore may form an underwater automotive pipe-laying apparatus as described in my Patent application Ser. No. 06/459,395 filed 4/18/83 by substituting the panels and soldier beams herein described for the crawler track panels in said Application.

Furthermore, any adaptation described in said Application may be used in present shore where applicable.

I claim:

1. A traveling trench shoring device of the type consisting of longitudinal panels which cover the walls of the trench, the panels being supported transversely against the walls of the trench by movable frames on which hydraulic jacks are mounted that are connected to the panels and move the panels forward, the reaction for the jacks being taken by the frames which are held in position by other jacks attached to other panels, which panels are held stationary by the friction between them and the walls of the trench; the device comprising:

a work chamber which supports the walls of the trench where permanent structure is installed, and a separate unconnected leading section which supports the walls of a sloping approach to the trench, the two sections being adjoining and in longitudinal alinement;

said panels being movable vertically individually in succession;

the panels having plates on their lower outer edges and ends to cover the junction with panels below and behind them and prevent entry of earth between them;

and the jacks being mounted on collars on the frames, and the collars and jacks also being movable vertically and indvidually in conjunction with the panels.

2. A trench shoring device as claim 1, travel of the shoring device being effected by advancing every third panel, counting vertically, simultaneously.

3. A trench shoring device as claim 1, having dollies, consisting of an endless chain of rollers, mounted on the frame for the panels to roll on.

4. A trench shoring device as claim 1, having vibrators mounted on the panels to reduce friction between the panels and the walls of the trench.

5. A trench shoring device as claim 1, having percussion tools mounted on the ends of the jack pistons to help overcome friction between the panels and the walls of the trench.

6. A trench shoring device as claim 1, having means for transferring the loads of the panels to the permanent structures where the structures interfere with the line of the cross braces, said means comprising struts with dollies, consisting of a frame with an endless chain of rollers, which roll on the structures.

7. A trench shoring device as claim 6, having means for relieving the stress in the structures due to the concentrated loads from the panels, said means being similar to those in claim 6, mounted on a movable frame inside the structure and comprising struts with dollies which roll on the inside of the structure opposite the dollies on the outside.

8. A trench shoring device as claim 1, the panel walls being set on a better to reduce the pressure on the cross braces and on the bottom of the trench.

9. A trench shoring device as claim 1, having endless crawler tracks mounted under the shoring device.

* * * * *